US008988297B2

(12) United States Patent
Leung et al.

(10) Patent No.: US 8,988,297 B2
(45) Date of Patent: Mar. 24, 2015

(54) LIGHT TRANSMISSABLE RESONATORS FOR CIRCUIT AND ANTENNA APPLICATIONS

(71) Applicant: City University of Hong Kong, Kowloon (HK)

(72) Inventors: Kwok Wa Leung, Hong Kong (HK); Eng Hock Lim, Selangor Darul Ehsan (MY)

(73) Assignee: City University of Hong Kong, Kowloon (HK)

( * ) Notice: Subject to any disclaimer, the term of this patent is extended or adjusted under 35 U.S.C. 154(b) by 0 days.

(21) Appl. No.: 13/893,648

(22) Filed: May 14, 2013

(65) Prior Publication Data

US 2013/0249757 A1 Sep. 26, 2013

Related U.S. Application Data

(63) Continuation of application No. 12/624,562, filed on Nov. 24, 2009, now Pat. No. 8,547,287.

(51) Int. Cl.
*H01Q 1/06* (2006.01)
*H01Q 9/04* (2006.01)

(52) U.S. Cl.
CPC ..... *H01Q 9/0485* (2013.01)
USPC ..... 343/721; 343/700 MS; 343/785

(58) Field of Classification Search
None
See application file for complete search history.

(56) References Cited

U.S. PATENT DOCUMENTS 5,293,447 A 3/1994 Fanney et al.
6,737,809 B2 * 5/2004 Espiau et al. ..... 315/39

(Continued)

FOREIGN PATENT DOCUMENTS

CN 102097676 A * 6/2011 ..... H01Q 19/10

OTHER PUBLICATIONS

"Transparent Dielecric Resonator Antennas for Optical Applications" by En Hock Lim and Kwok Wa Leung; IEEE Published Apr. 2010, 2 pages.

(Continued)

*Primary Examiner* — Trinh Dinh
(74) *Attorney, Agent, or Firm* — Renner Kenner Greive Bobak Taylor & Weber

(57) ABSTRACT

Provided is a circuit for an electronic device having a non-planar transparent resonator. The transparent resonator is mounted on said circuit so as to at least partially occupy a footprint of another component of the circuit. The transparent resonator forms part of a light pathway on said circuit for transmitting light to or from said another component. Also provided is a transparent dielectric resonator antenna (DRA) for optical applications. Since the DRA is transparent, it can let light pass through itself and, thus, the light can be utilized by an optical part of a system or device. The transparent DRA can be placed on top of a solar cell. Since the DRA does not block the light, the light can reach the solar cell panel and power can be generated for the system or device. The system or device so obtained is very compact because no extra footprint is needed within the system or device for the DRA. It finds application in compact wireless applications that need a self-sustaining power device.

5 Claims, 9 Drawing Sheets

(56) References Cited

U.S. PATENT DOCUMENTS

| | | | | |
|---|---|---|---|---|
| 6,812,800 | B2 * | 11/2004 | Matsuura et al. | 331/94.1 |
| 7,081,702 | B2 * | 7/2006 | Seo | 313/153 |
| 7,446,707 | B2 * | 11/2008 | Poe et al. | 343/700 MS |
| 8,310,404 | B2 * | 11/2012 | Kishimoto et al. | 343/721 |
| 8,504,287 | B2 * | 8/2013 | Hung | 701/429 |
| 2003/0043075 | A1 * | 3/2003 | Bit-Babik et al. | 343/700 MS |
| 2005/0286263 | A1 * | 12/2005 | Champion et al. | 362/558 |
| 2006/0107744 | A1 | 5/2006 | Li et al. | |
| 2007/0236119 | A1 * | 10/2007 | Espiau | 313/110 |
| 2010/0214542 | A1 * | 8/2010 | Kito et al. | 353/122 |
| 2011/0057841 | A1 * | 3/2011 | Betts-LaCroix | 343/700 MS |
| 2011/0122036 | A1 * | 5/2011 | Leung et al. | 343/785 |
| 2011/0260937 | A1 | 10/2011 | Leung et al. | |
| 2012/0242159 | A1 | 9/2012 | Lou et al. | |

OTHER PUBLICATIONS

"Integrated Solar Panel Antennas for Cub Satellites" by Mahmound N. Mahmound, Uth State University; May 1, 2010; pp. 1-4 and 64-65.

Office Action Restriction dated dated Jul. 10, 2012 in U.S. Appl. No. 12/624,562.

Office Action dated Sep. 18, 2012 in U.S. Appl. No. 12/624,562.

Office Action dated Mar. 15, 2013 in U.S. Appl. No. 12/624,562.

* cited by examiner

LIGHT TRANSMISSABLE RESONATORS FOR CIRCUIT AND ANTENNA APPLICATIONS

CONTINUITY DATA

This application is a continuation of, claims priority to and the benefit of, U.S. Ser. No. 12/624,562 filed Nov. 24, 2009 and entitled "LIGHT TRANSMISSIBLE RESONATIONS FOR CIRCUIT AND ANTENNA APPLICATIONS". All of which is incorporated herein in its entirety.

FIELD OF THE INVENTION

The invention relates to a light transmissible resonator for circuit and antenna applications and more particularly to a dielectric resonator antenna having a light transmissable dielectric resonator element preferably shaped to focus light impinging on a surface of said resonator element.

BACKGROUND OF THE INVENTION

Resonators have been widely used in microwave and millimeter wave circuits such as filters, oscillators and antennas, for example. These components comprise important parts of many wireless systems and devices, although their uses are not confined to wireless applications.

It is also known that a dielectric resonator (DR) can be used as a circuit element in oscillator and filter circuits, or as an effective radiator that is now commonly known as a DR antenna (DRA). In the past two decades, the DRA has been studied extensively due to a number of advantages it provides such as its small size, low loss, low cost, light weight, and ease of excitation. DRAs are miniaturized antennas of ceramics or other dielectric media for microwave frequencies. DRAs are fabricated entirely from low loss dielectric materials and are typically mounted on ground planes. Their radiation characteristics are a function of the mode of operation excited in the DRA. The mode is generally chosen based upon operational requirements. DRAs offer several advantages over other antennas, such as small size, high radiation efficiency, and simplified coupling schemes for various transmission lines. The bandwidth can be controlled over a wide range by the choice of dielectric constant, and the geometric parameters of the resonator.

By using a dielectric resonator (DR), a size of an antenna can be scaled down by roughly a factor of $1/\sqrt{\epsilon_r}$, where $\epsilon_r$ is the dielectric constant of the DR element material. This can be very useful in reducing the antenna size, particularly in wireless communication applications. Today, compactness has become one of the topmost priorities in developing wireless communication devices and systems, supporting the development of multifunction components to miniaturize the devices and systems. As a result, there has been a trend to bundle several microwave functions into a single module, e.g. to combine several microwave resonators to provide multiple functions. It has also been shown to design a microstrip single-resonator balun-filter. Furthermore, it has recently been shown to design an antenna and filter using a single DR. Also, it has been demonstrated that the DRA can be integrated with an oscillator circuit.

With the advent of the ultrawide-band and millimeter-wave era, it has become increasingly normal to combine microwave and optical circuits in modern communication systems. The transparent microstrip antenna has been studied for optical applications, but having a highly conducting transparent film is still a challenging problem. As the conductivity of the conductive transparent film (~$5\times10^5$ S/m) is relatively low as compared with that of metals, most of the transparent planar antennas reported thus far have an antenna gain of lesser than 0 dBi. It has been proposed to apply conductive paste to the slot edge of the transparent microstrip antenna for improving the radiation efficiency. Using this technique, the antenna gain has been increased from about −5 dBi to ~0 dBi, but at the cost of reducing the transparency of the antenna.

Several studies on the integration of planar antennas and solar cell panels have also previously been reported. The integration of a microstrip antenna and a solar cell panel usually causes the antenna gain to degrade significantly, although recent efforts have advanced the technology to increase the antenna gain of the solar-cell-integrated (metallic) microstrip antenna to ~1.05 dBi. However, this is still ~6 dB lower than that of metallic microstrip antennas. Moreover, the effective illumination area of the solar cell panel is somewhat reduced because of introducing the non-transparent microstrip antenna. In order to solve this problem, it has been proposed to use a slot antenna, but this requires a removal of part of the solar cell panel which is undesirable.

OBJECTS OF THE INVENTION

An object of the invention is to provide a circuit including a transparent resonator component mounted in the circuit so as to occupy at least a part of or the same footprint as another component of the circuit whilst allowing light impinging on the resonator component to reach said another component.

Another object of the invention is to provide a light transmissable dielectric resonant antenna, e.g. a light transmissive or transparent DRA.

Another object of the invention is to mitigate or obviate to some degree one or more problems associated with known transparent microstrip antennas.

Another object of the invention is to mitigate or obviate to some degree one or more problems associated with known resonator components or electronic devices or circuits including such resonator components.

Another object of the invention is to provide an electronic device which integrates or combines a solar cell or like device with a light transmissable DRA.

Another object of the invention is to provide a dual function antenna that additionally provides the function of a lens for focusing light.

Another object of the invention is to improve wireless communication systems and devices.

One skilled in the art will derive from the following description other objects of the invention. Therefore, the foregoing statements of object are not exhaustive and serve merely to illustrate some of the many objects of the present invention.

SUMMARY OF THE INVENTION

The present invention provides a circuit for an electronic device having a transparent resonator. The transparent resonator may be mounted on the circuit so as to at least partially occupy a footprint of another component of the circuit. The transparent resonator may be mounted on said circuit such that it comprises a part of a light pathway for said another component so as to allow light impinging on said resonator component to reach said another component or to allow light generated by said another component to be transmitted away from said another component. In one particular embodiment a dual function transparent, shaped (preferably hemispherical) DRA that simultaneously functions as an antenna and a focusing lens for a solar cell is provided. To make the system compact, the solar cell is placed beneath the DRA to save the footprint on the ground plane or grounded substrate of the DRA. The DRA can also serve as a protective cover for the solar cell. A conformal strip or feedline strip is used to excite the transparent, shaped DRA in its dominant $TE_{111}$ mode. Due to its focusing effect, the shaped DRA can increase the output voltage and current of the solar cell. The solar cell can be employed to power an electronic device such as a wireless communication device, e.g. a personal digital assistant (PDA), a mobile phone, although many other wireless enabled devices can also be envisaged such as a remote controller or the like. The solar cell with integrated or combined DRA can also be employed in other more substantial communication devices such as wireless communication base stations.

In a first main aspect of the invention, there is provided a circuit for an electronic device having a non-planar transparent resonator wherein the transparent resonator is mounted on said circuit so as to at least partially occupy a footprint of another component of the circuit and wherein said transparent resonator forms part of a light pathway on said circuit for transmitting light to or from said another component. The another component may be an optical component that is arranged to generate light for transmission via the light pathway or to process light received thereat via said light pathway.

Preferably, the resonator element is shaped so as to focus light impinging on a surface thereof. Preferably, the material comprising the resonator element is transparent to light at and/or beyond optical frequencies, i.e. visible and/or invisible light frequencies. More preferably, the material of the resonator element comprises borosilicate glass. Preferably, the glass is borosilicate crown glass, commonly known by the tradenames "Pyrex" or "K9".

The resonator element may be shaped such that light impinging on a surface of said resonator element is focused by the resonator element. The resonator element may be hemispherical in shape with a surface defining the hemispherical shape comprising the light impinging surface, although any suitable lens shape that acts to focus light may be utilised. The resonator element may be shaped such that light impinging on a surface of said resonator element is focused by the resonator element towards a selected region of another surface of the resonator element. The resonator element may be a resonator element of a dielectric resonator antenna (DRA), said DRA comprising one of a plurality of DRAs arranged in a DRA array or a DRA reflect-array. An antenna array is a matrix of antennas used to increase the gain of an antenna system.

In a second main aspect of the invention, there is provided a dielectric resonator antenna (DRA) comprising: a dielectric resonator (DR) element; a ground plane; and a strip feedline for the DR element; wherein the material comprising the DR element comprises a material that is transmissable to light at and/or beyond optical frequencies, i.e. visible and/or invisible light frequencies.

The transparent DRA is proposed to circumvent the problem associated with known transparent microstrip antennas in that the transparent DRA of the invention does not need any conducting parts to resonate. More importantly, it can provide an antenna gain of more than 4 dBi across its entire passband, which is a new achievement for a transparent antenna.

Preferably, the material comprising the DR element is transparent to light at and/or beyond optical frequencies, i.e. visible and/or invisible light frequencies. More preferably, the material of the DR element comprises borosilicate glass. Preferably, the glass is borosilicate crown glass, commonly known by the tradenames "Pyrex" or "K9".

The DR element may be shaped such that light impinging on a surface of said DR element is focused by the DR element. The DR element may be hemispherical in shape with a surface defining the hemispherical shape comprising the light impinging surface, although any suitable lens shape that acts to focus light may be utilised. The DR element may be shaped such that light impinging on a surface of said DR element is focused by the DR element towards a selected region of another surface of the DR element. This is particularly useful where the DRA is positioned in an electronic device in a light pathway of another component such as a solar cell or a light transmitting device such as a lamp or LED or the like.

The dielectric resonator antenna may comprise one of a plurality of DRAs arranged in a DRA array or a DRA reflect-array for a circuit or system.

In a third main aspect of the invention, there is provided an electronic device including a DRA according to the second main aspect, wherein the DRA functions as an antenna of said electronic device and wherein said DRA is positioned in said device so that the DR element is located so as to intercept light travelling along a light pathway of said device. At least a portion of the DR element may define the light pathway of the electronic device.

The DR element may be used as a protective cover for an electronic component of the electronic device whilst allowing light traveling along said light pathway to reach said electronic device.

The electronic device may include a light transmitting element such as a lamp, wherein said light transmitting element is located such that light from said light transmitting element is transmitted through at least a part of the DR element of the DRA.

The electronic device preferably includes a device for generating power from light impinging on said device, wherein said power generating device is located such that light impinging upon said device travels through at least a part of the DR element of the DRA. Preferably, the power generating device comprises a solar cell device. The gain of the DRA according to the invention is virtually not affected by the solar cell panel. Also, there is no need to remove any parts of the panel. Preferably, the DR element is shaped such that light impinging on a surface of said DR element is focused by the DR element towards a light receiving part of said solar cell.

Preferably, the power generating device generates power for said electronic device from light impinging on said electronic device and conveyed to said power generating device by the DR element of the DRA.

The electronic device may comprise a plurality of dielectric resonator antennas arranged in an array or a reflect-array for increasing antenna gain for a circuit or system.

In a fourth main aspect of the invention, there is provided a method of producing a DRA according to the first main aspect comprising providing a DRA having: a DR element; a ground plane; and a strip feedline for the DR element; and forming the DR element from a material that is transmissable to light at optical frequencies.

BRIEF DESCRIPTION OF THE DRAWINGS

The foregoing and further features of the present invention will be apparent from the following description of preferred embodiments which are provided by way of example only in connection with the accompanying figures, of which.

DESCRIPTION OF PREFERRED EMBODIMENTS

Figure 1A:
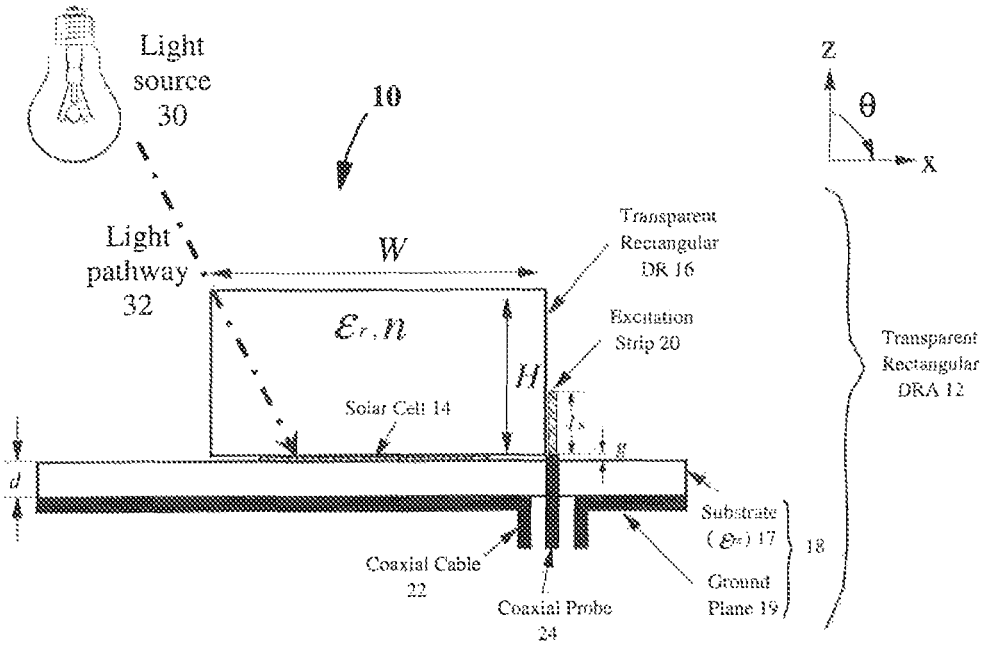
FIGS. 1*a* and 1*b* are front side and top views respectively of a transparent rectangular DRA in accordance with the invention with an underlaid solar cell.

Disclosed herein in all embodiments is a circuit for an electronic device having a non-planar transparent DRA wherein the transparent DR is mounted on another component so as to at least partially occupy a footprint of another component of the circuit and wherein said transparent DR forms part of a light pathway on said circuit for transmitting light to or from said another component. The another component may be an optical component that is arranged to generate light for transmission via the light pathway or to process light received thereat via said light pathway. The DR may be shaped so as to focus light impinging on a surface thereof. Preferably, the material comprising the DR is transparent to light at and/or beyond optical frequencies, i.e. visible and/or invisible light frequencies. More preferably, the material of the DR comprises borosilicate glass. Preferably, the glass is borosilicate crown glass, commonly known by the tradenames "Pyrex" or "K9". The DR may be shaped such that light impinging on a surface of said DR is focused by the DR. The DR may be hemispherical in shape with a surface defining the hemispherical shape comprising the light impinging surface, although any suitable lens shape that acts to focus light may be utilised. The DR may be shaped such that light impinging on a surface of said DR is focused by the DR towards a selected region of another surface of the DR.

Also disclosed herein in some embodiments is a transparent dielectric resonator antenna (DRA) for optical applications. Since the DRA is transparent, it can let light pass through itself and, thus, the light can be utilized by other optical or light receiving and/or light transmitting components of a system or device. As an example, the transparent DRA can be placed on top of a solar cell. Since the DRA does not block the light, the light can reach the solar cell panel and power can be generated. The system so obtained is very compact because no or little extra footprint is needed for the DRA. It is potentially very useful for compact wireless applications that need a self-sustaining power source. Another embodiment includes a light source inside a hollow transparent DRA, giving a lamp that also works as an antenna for an electronic device or system.

DRAs offer simple coupling schemes to nearly all transmission lines used at microwave and mm-wave frequencies. This makes them suitable for integration into different planar technologies. The coupling between a DRA and a planar transmission line can be easily controlled by varying the position of the DRA with respect to the line. The performance of DRA can therefore be easily optimized experimentally.

The preferred embodiments disclosed herein combine microwave and optical functions into a single piece of dielectric resonator material. In a first described embodiment, a non-focusing lens is simultaneously used as the DRA. The footprint of the system is minimized because the solar cell panel is placed beneath the DRA. In a second described embodiment, the DRA is shaped to focus light and is used as a focusing lens for the solar cell. By incorporating a transparent shaped DRA, the output voltage and current of the underlaid solar cell can be increased. In addition, the DRA also works as a radiating element (antenna). The dual function can reduce costs. In another embodiment, the DRA is shaped to conform to a light emitting bulb to form a lamp or the like. The DRA of any of these embodiments can be incorporated as a dual or multi-function element in an electronic device. The DRA can act as a light transmissible element for an optical component whilst acting as a protective cover for said other component. Furthermore, the DRA can act as a light focusing or transmission medium for said optical component.

The dual or multi-function DRAs of the described embodiments are particularly useful for wireless systems or devices that need power for sustaining themselves or for other purposes.

Figure 1B:
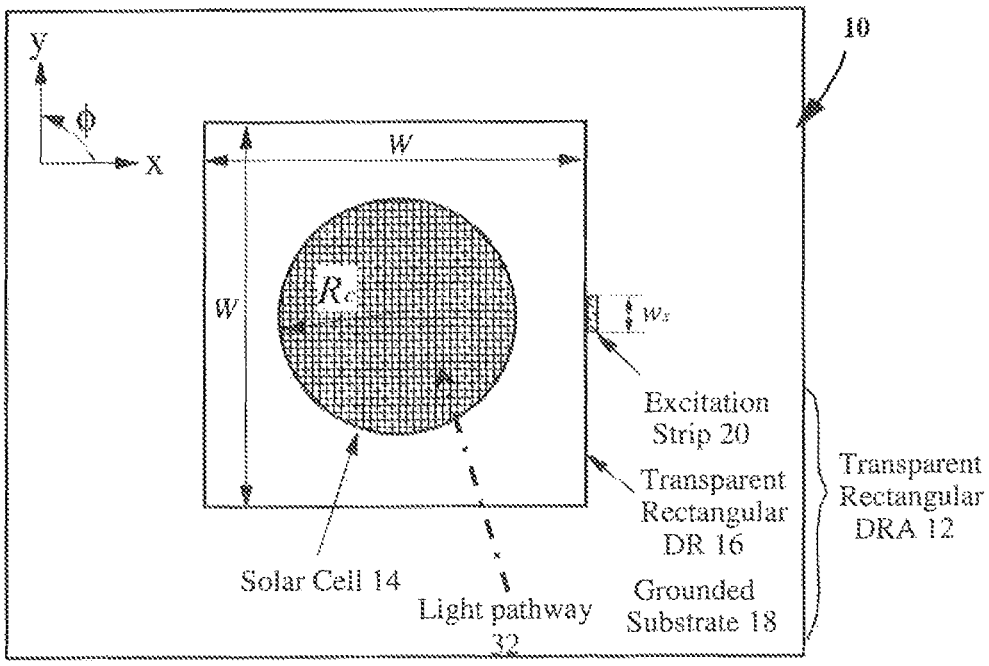

Referring to FIGS. 1*a* and 1*b*, a first embodiment of a circuit 10 including a DRA 12 in accordance with the invention is described. This embodiment of a DRA 12 comprises a non-focusing transparent rectangular DR 16. As a rectangular DR is mechanically easier to fabricate than other shapes, it is of great interest to antenna engineers.

In this case, the DR 16, in addition to serving as an antenna, serves as a protective cover for an underlaid solar cell 14 or a photovoltaic element which is arranged to convert light to electrical power. In this example embodiment, the photovoltaic element is a solar cell 14 arranged to convert light beam 30 into electrical power. Alternatively, the photovoltaic element may be a solar panel comprising a plurality of solar cells. The photovoltaic element may also be implemented as a solar module integrated to a circuit or a device in some embodiments. Alternatively, the solar radiation source is a lighting source powered by fuel or electrical power such as, but not limited to, in-house lighting apparatus, a gas light, street light. As the DR 16 is transparent, it does not deter the solar cell 14 from collecting sunlight, ambient light or any other light source 30. In addition, high compactness can be easily achieved by placing the solar cell 14 beneath the DR 16 in order to reduce or minimize the footprint occupied by the combined components. The DRA 12 comprises a dielectric resonator (DR) 16; a ground plane or grounded substrate 18 comprising a non-conductive substrate 17 and a conductive ground plane layer 19; and a strip feedline (conformal strip) 20 for exciting the DR 16. The conformal strip 20 is connected to a central conductor or coaxial probe 24 of a coaxial cable 22, although it will be understood that the conformal strip can be connected to any suitable conductor for supplying excitation energy to the DR 16. The material comprising the DR 16 comprises a material that is transmissable to light at and/or beyond optical frequencies, i.e. visible and/or invisible light frequencies, and is preferably transparent in order not to reduce visible or invisible light energy reaching the underlaid solar cell 14. Preferably, the material of the visibly transparent DR 16 comprises borosilicate glass such as borosilicate crown glass, commonly known by the tradenames "Pyrex" or "K9". This is particularly useful where the DR 16 is positioned in an electronic device or on a circuit 10 in a light pathway 32 of another component such as the solar cell 14 or a light transmitting device 30 such as a lamp or LED (not shown) or the like.

The transparent DRA 12 is proposed to circumvent a problem associated with known transparent microstrip antennas in that the transparent DRA of the invention does not need any conducting parts to resonate.

In this embodiment, the DR 16 has a width of W and is placed above the solar cell 14. The glass of the DR 16 has a dielectric constant of $\in_r$ at microwave frequencies and a refractive index of n at optical frequencies. A vertical strip comprising the conformal excitation strip 20 with a length of $l_s$ and a width of $w_s$ is used to feed the DR 16, which is excited in its fundamental $TE_{111}$ mode, although other modes may be selected depending on operating conditions, etc. The DR 16 is lifted up by a small gap of g for accommodating the solar cell 14. Alternatively, the solar cell 14 can be directly made at the bottom surface of the DR 16. In this latter arrangement, the bottom of the DR 16 may be recessed to accommodate the solar cell 14. In such a case, the DR 16 may have a slightly larger footprint than the solar cell 14 such that a peripheral edge portion on a bottom surface of the DR 16 acts to support the DR 16 on the grounded substrate 18. The recess may be made to be slightly larger, at least in height, than the solar cell 14 such that the DR 16 is not resting on the solar cell 14, but it is preferred that there is an intimate contact between the bottom surface of the DR 16 and the top surface of the solar cell 14, or at least a light collecting part of the top surface of the solar cell 14.

A solar cell 14 of any shape can be placed beneath the DR 16 for collecting sunlight or ambient light. In this embodiment, a solar cell 14 with a radius of $R_c$ is used. It will be demonstrated below that the DR 16 does not significantly affect the output current and voltage of the underlaid solar cell to any great degree.

Figure 2A:
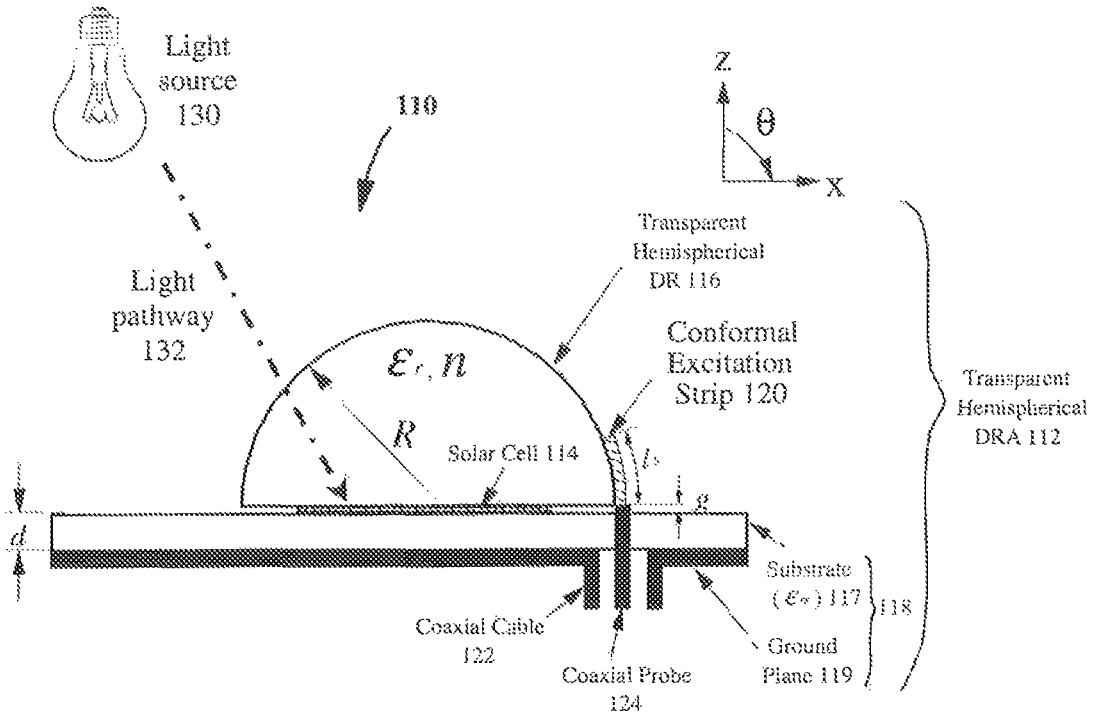
FIGS. 2*a* and 2*b* are front side and top views respectively of a transparent shaped DRA in accordance with the invention with an underlaid solar cell.
Figure 2B:
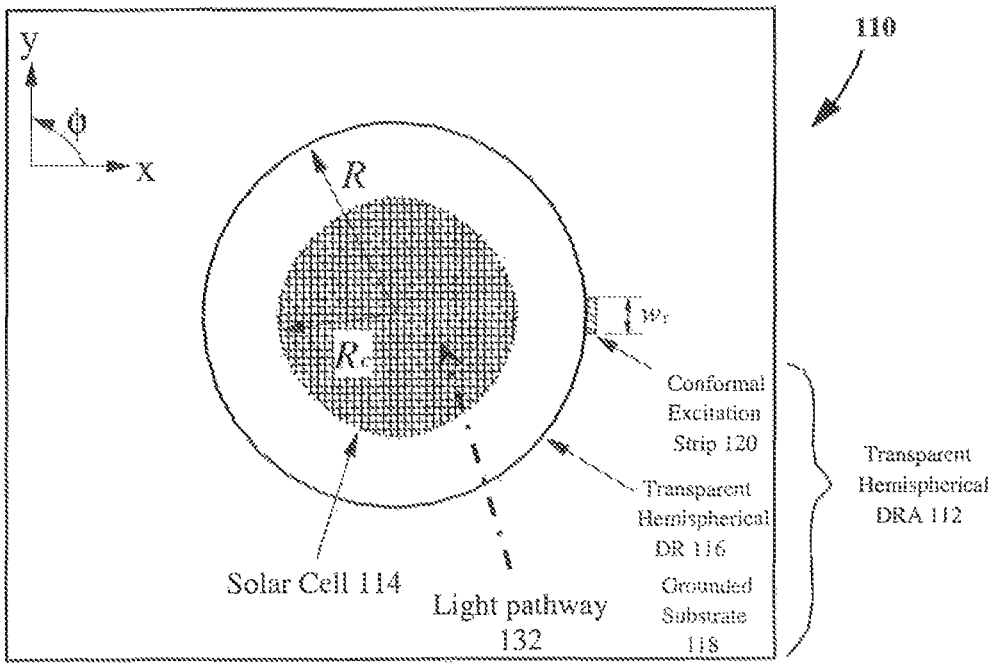

Referring to FIGS. 2*a* and 2*b*, a second embodiment of a DRA 112 in accordance with the invention is described. This embodiment of a DR 116 is mounted on a circuit 110 of an electronic device or system (not shown) and comprises a focusing transparent DR 116 which is shaped to focus light impinging on its upper surface and to convey the focused light to a selected region on a lower surface thereof adjacent an underlaid solar cell. The selected region may be chosen as a region that maps to or overlaps a light receiving part of the solar cell 114 when the DR 116 is mounted on the circuit 110 above the solar cell 114.

In this case, the DR 116, in addition to serving as an antenna and a protective cover for the underlaid solar cell 114, also acts to focus captured light onto a light receiving part of the solar cell 114 thereby enhancing performance of the solar cell whilst preserving a compact form by sharing a footprint with the solar cell 114. In this embodiment, the DRA 112 also comprises a dielectric resonator (DR) 116; a ground plane or grounded substrate 118 comprising a non-conductive substrate 117 and a conductive ground plane layer 119; and a strip feedline (conformal strip) 120 for exciting the DR 116. The conformal strip 120 is electrically coupled to a central conductor or coaxial probe 124 of a coaxial cable 122. The material comprising the DR 116 also comprises a material that is transmissable to light at optical frequencies and/or above, i.e. visible and/or invisible light frequencies, and is preferably transparent in order not to reduce light energy reaching the underlaid solar cell 114. In fact, the focusing effect of the DR 116 considerably enhances the concentration of light energy on the receiving part of the solar cell 114 thereby enhancing the power output of the solar cell 114 over what would be expected if the DR 116 did not have a focusing function. The material of the DR 116 preferably comprises borosilicate glass such as borosilicate crown glass.

This embodiment shares many similarities with the first embodiment except that its upper surface is shaped to form the DR 116 into a lens to focus light incident upon said upper surface. In this embodiment, the upper surface takes a hemispherical shape, but it will be understood that any suitable shape could be used to form the DR 116 into a lens for focusing light onto the solar cell 114. In other embodiments, the DR 116 may be shaped to convey light away from an optical light transmitting component of an electronic device. This is particularly useful where the DR is positioned in an electronic device in a light pathway 132 of another component such as a solar cell or a light transmitting device 130 such as a lamp or the like.

Again, in this embodiment, a solar cell 114 of any shape can be placed beneath the DR 116 for collecting sunlight and it will also be demonstrated below that the hemispherical DR 116 can be used to increase the output current and voltage of the underlaid solar cell 114.

In order to validate the above described embodiments of a transparent DRA 12, 112 with an underlaid solar cell 14, 114, prototypes according to said embodiments were fabricated and tested with experimental results being investigated against simulated results obtained using Ansoft HFSS™ which is an industry standard simulation tool for 3D full wave electromagnetic field simulation. A first prototype in accordance with the embodiment of FIGS. 2*a* and 2*b* was prepared. In the first prototype illustrated by FIGS. 2*a* and 2*b*, the transparent hemispherical DR 116 was made of borosilicate crown glass. The DRA of this prototype has a radius of R=28 mm and is placed above the solar cell 114. A conformal strip (excitation feedline) 120 with a width of $w_s$=12 mm and a length of $l_s$=19 mm is used to feed the DR 116, which was excited in its fundamental $TE_{111}$ mode at 1.87 GHz. By using the Agilent 85070D Dielectric Probe Kit, the dielectric constant of the glass was measured and was found to be equal to $\in_r$=7.0 round 1.9 GHz. It should be mentioned that at optical frequencies, the glass has a much lower dielectric constant of $\in_r$=2.17, which was calculated from its refractive index of n=1.474.

A square solar cell was used. The solar cell was assumed to have dielectric properties having the values of $\in_r$=1.5 and tan $\delta$=10 and these were used in the Ansoft HFSS™ simulation of this prototype. The solar cell has a side length and a thickness of $W_c$=55 mm and 1.8 mm, respectively, whereas its left and right output pins at the back have a height of 0.2 mm. Because of the thickness of the solar cell (1.8 mm) and the height of the output pins (0.2 mm), the DR 116 has a displacement of 2 mm from the substrate. This information was input in the HFSS simulation. The ground plane substrate has a dielectric constant of $\in_{rs}$=2.33, a thickness of d=1.57 mm, and a size of 16×16 $cm^2$. It can serve as an additional insulator between the solar cell and the ground plane. The output pins of the solar cell were connected to a voltmeter and an ammeter for measurements of the voltage and current, respectively. To study the focusing effect of the DR 116, the solar cell is masked with a circular exposure area having a radius of $R_c$=15 mm. A very thin and dark hard paper was used as the mask, but this was not included in the simulation.

The transparent rectangular DRA 12 of FIGS. 1*a* and 1*b* was also made into a prototype and investigated for non-focusing applications. For ease of comparison with the focusing DRA 112 of FIGS. 2*a* and 2*b*, the rectangular DR 16 was designed to resonate at the resonance frequency of its hemispherical counterpart of FIGS. 2*a* and 2*b*. The DR 16 was excited in its fundamental broadside $TE_{111}$ mode using a vertical excitation strip. FIGS. 1*a* and 1*b* shows the configuration, with $\in_r$=7, W=50 mm, H=22 mm, g=2 mm, d=1.57 mm, $w_s$=12 mm, and $l_s$=22 mm. The same masked solar cell was used again in this investigation.

Figure 3:
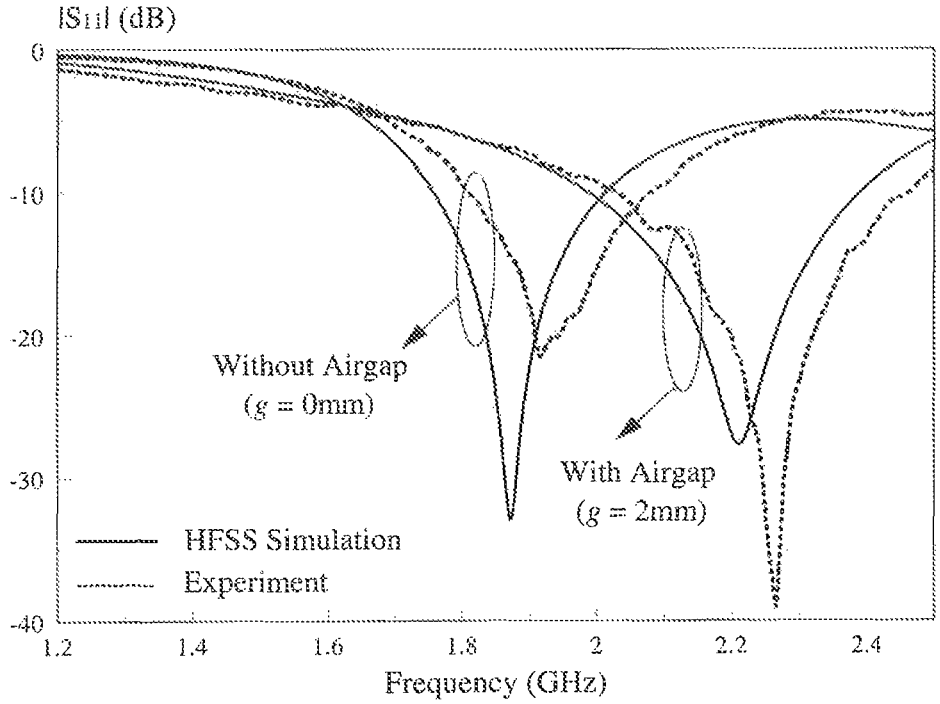
FIG. 3 shows the measured and simulated reflection coefficients of the hemispherical DRA of FIGS. 2*a* and 2*b* for g=0 and 2 mm.
Figure 4:
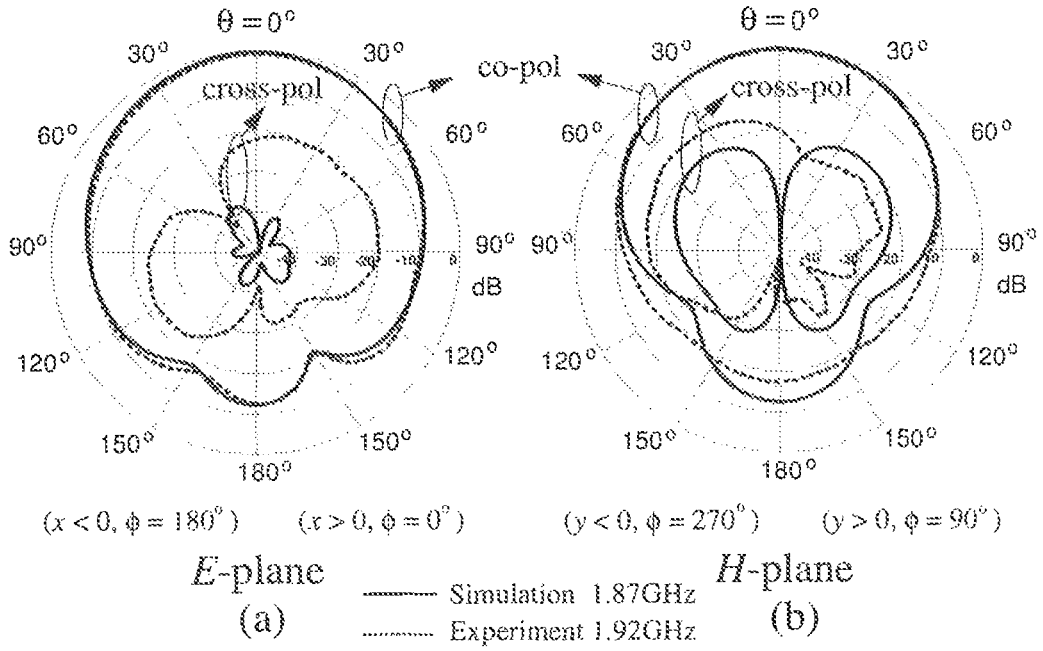
FIG. 4 comprises a graph of simulated and measured normalized radiation patterns of the hemispherical DRA of FIG. 2 with g==0 mm with no underlaid solar cell.

Ansoft HFSS was used to simulate the antenna part of each of the prototype configurations, and measurements were carried out using the Agilent 8753 to verify the results. The effect of the airgap g between the DRA and substrate is studied first without considering the solar cell, i.e. with no solar cell present. FIG. 3 shows the measured and simulated reflection coefficients of the hemispherical DRA 112 of FIGS. 2*a* and 2*b* for g=0 and 2 mm, and reasonable agreement between the measured and simulated results is observed for each case. With reference to FIG. 3, it can be seen that the airgap causes the measured resonant frequency and impedance bandwidth ($|S_{11}|\leq-10$ dB) to increase from 1.92 GHz to 2.26 GHz and from 14% to 19%, respectively. The antenna gains of the two prototype DRAs (g=0 and g=2 mm) of FIGS. 1 and 2, respectively, were measured and found to be in the range of 4-6.8 dBi across their passbands. It was observed that a DRA with an airgap has a wider gain bandwidth, which is to be expected. It is found that the antenna gain is ~5 dBi around the resonance for each case, which is typical for a DRA. The simulated and measured radiation patterns for g=0 for the hemispherical DRA 112 are shown in FIG. 4. As can be observed from the figure, the co-polarized fields of both the E- and H-planes are stronger than the cross-polarized fields by more than 20 dB in the boresight direction (θ=0°). The radiation pattern for g=2 mm was also simulated and measured and very similar results were obtained.

Figure 5:
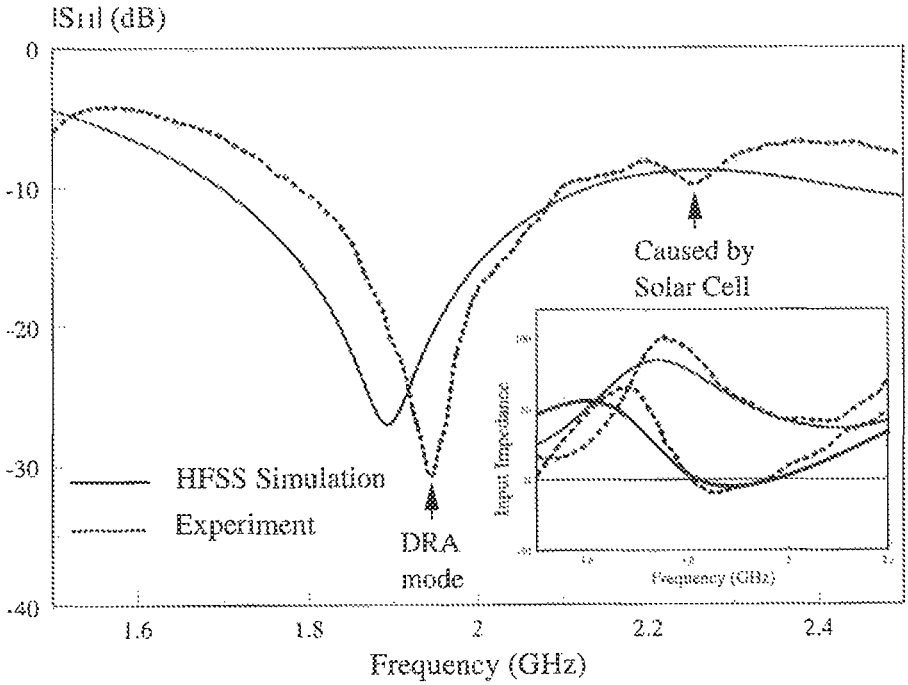
FIG. 5 comprises simulated and measured reflection coefficients of the hemispherical DRA of FIG. 2 with the underlaid solar cell.

Next, the characteristics of the hemispherical DRA 112 with the underlaid solar cell 114 (FIG. 2) are investigated. FIG. 5 shows the simulated and measured reflection coefficients of the configuration. As can be observed from the figure, the measured and simulated resonant frequencies of the DRA 112 are 1.94 GHz and 1.89 GHz, respectively, with an error of 2.65%. The measured and simulated impedance bandwidths are given by 16.5% and 22.8%, respectively. Although the DR 116 in this case also has a displacement of 2 mm from the substrate as for the previous one with the airgap, its measured resonant frequency (1.94 GHz) is lower than that of the airgap case (2.26 GHz). This is because the solar cell 114 increases the effective dielectric constant of the DR 116. It is interesting to note that the measured resonant frequency (1.94 GHz) is quite close to that of the DRA (1.92 GHz) resting on the ground plane (g=0). With reference to the figure, a small resonant mode was measured at 2.25 GHz. This mode is caused by the solar cell, which can be verified by the fact that it was still observed when the rectangular DR was used. The simulated result does not predict this resonance mode, which is not surprising because the exact dielectric parameters of the solar cell were not known.

Figure 6:
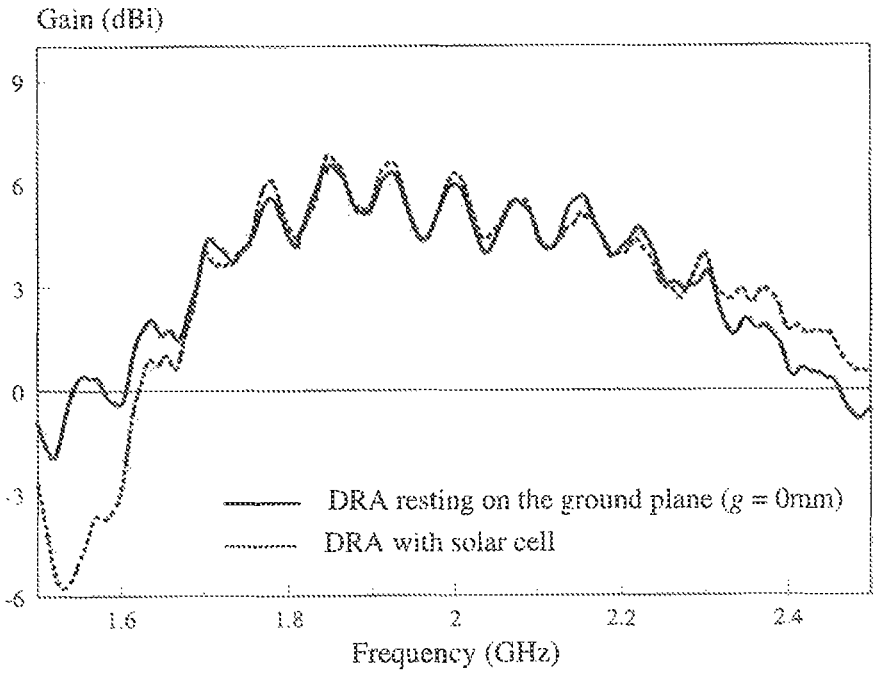
FIG. 6 is a graph of measured antenna gains of the hemispherical DRA with and without (g=0 mm) the solar cell.
Figure 7:
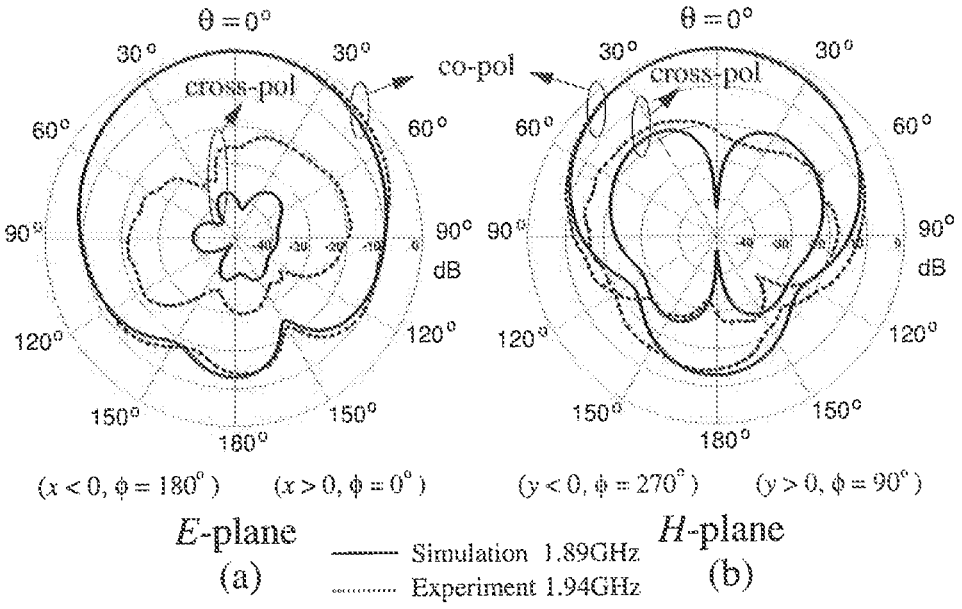
FIG. 7 comprises simulated and measured normalized radiation patterns of the hemispherical DRA with the underlaid solar cell.

FIG. 6 shows the measured antenna gains of the hemispherical DRA 112 with and without the underlaid solar cell. With reference to the figure, the two antenna gains are very close to each other around the resonance of the DRA. This is a very positive result, as it implies that the loss due to the solar cell is negligibly small. It is observed from the figure that the gain is ~5.3 dBi around the resonance. FIG. 7 shows the measured and simulated E- and H-plane radiation patterns. As can be seen from the figure, the co-polarized fields are stronger than their cross-polarized counterparts by more than 22 dB in the boresight direction.

Figure 8:
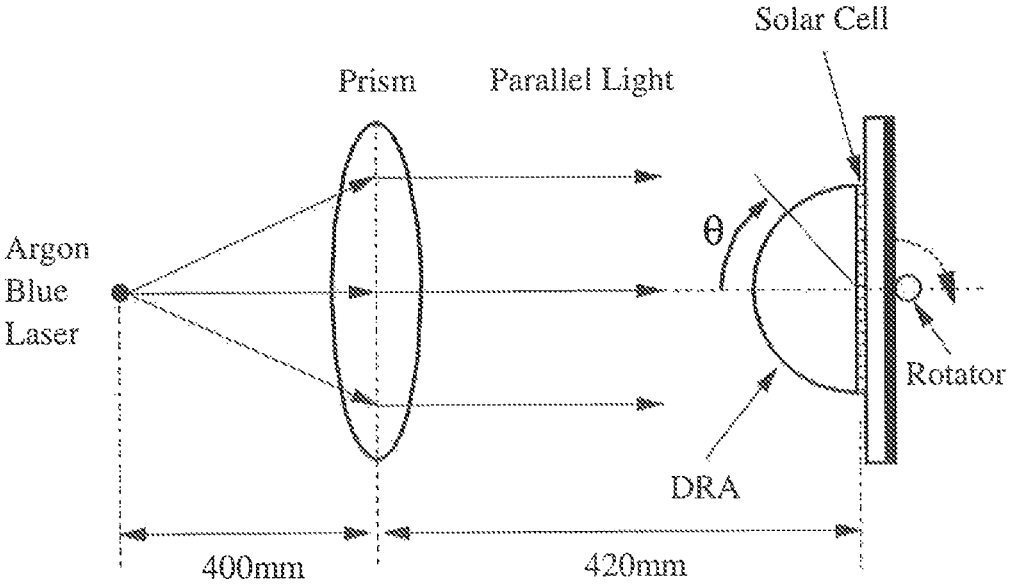
FIG. 8 provides a top-down view of the Coherent Sabre Innova Argon Laser system for generating parallel blue light beams.
Figure 9:
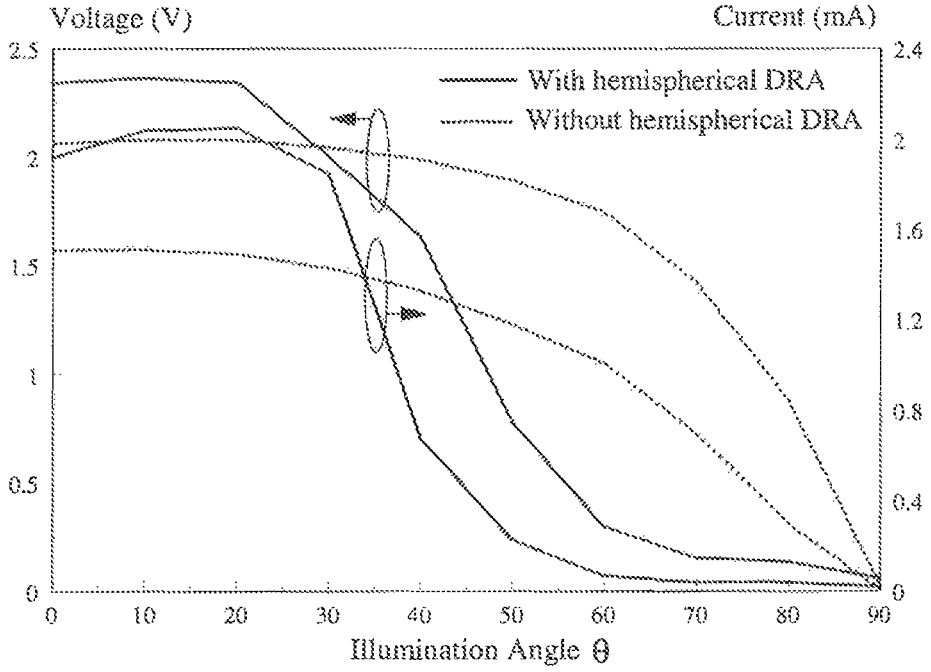
FIG. 9 shows output voltages and currents of the solar cell with and without the hemispherical DRA where $R_c$=15 mm.

A Coherent Sabre Innova Argon Laser 210 was used in the optical measurement of the solar cell with the DRAs 12, 112, and, assisted by a prism 215, parallel blue light beams at a wavelength of 488 nm were generated. The laser 210 was tuned and provided an even light power of 130 mW to the DRA. To measure the outputs of the solar cell at different illumination angles (θ), the DRA was placed on a rotator 200, as shown in FIG. 8. FIG. 9 shows the measured output voltage and current of the solar cell for the hemispherical DRA 112 as a function of θ, respectively. Also shown in the figure are the outputs without the DRA. With reference to the figure, larger outputs can be obtained for θ<30° by using the DRA because of its focusing effect. With the hemispherical DR 116, the output voltage and current are increased by 13.5% and 27.2% at θ=0°, respectively. A smaller exposure radius of $R_c$=5 mm was also used for the mask. Again, larger outputs were obtained for θ<30° when the DR is present. In this case, the voltage and current outputs at θ=0° were increased by 11% and 21.4% with the use of the DR, respectively. The curves, however, are not included here for brevity. In practical applications, the solar cell can be associated with a mechanical rotator so that it can track the light source if needed. In this case, the proposed DRA can be designed into a phased array so that it can scan the beam as the solar cell panel rotates.

Figure 10:
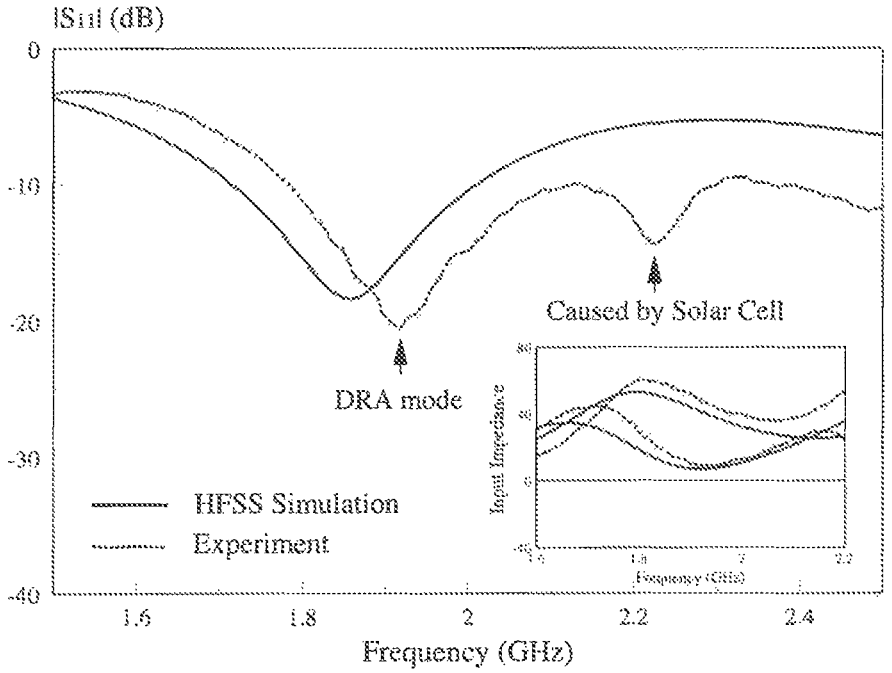
FIG. 10 comprises simulated and measured reflection coefficients of the transparent rectangular DRA with the underlaid solar cell of FIG. 1.
Figure 11:
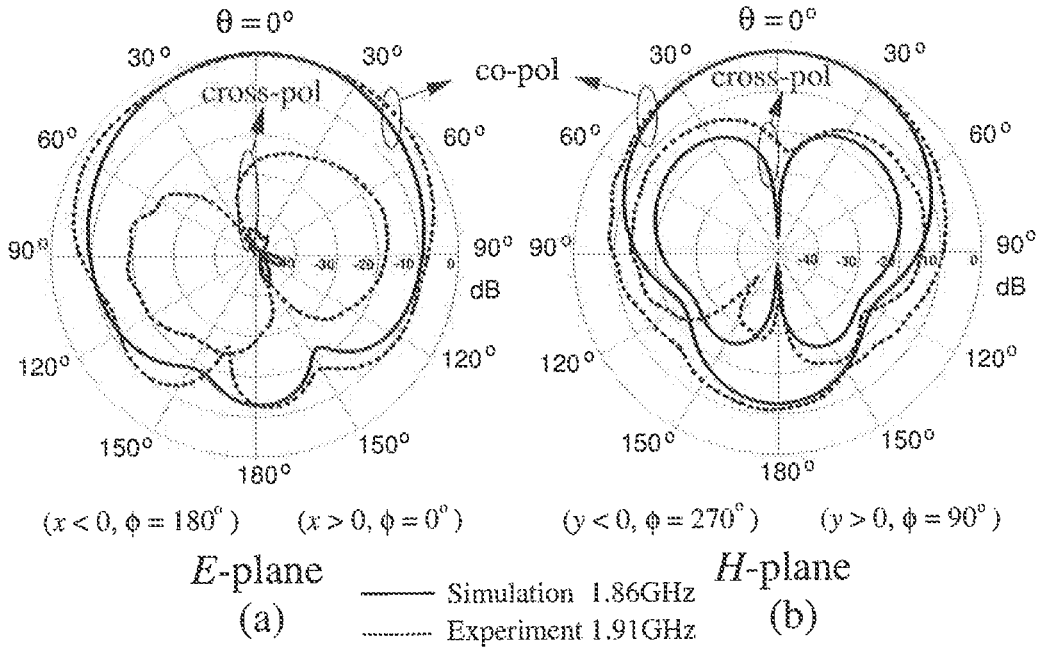
FIG. 11 comprises simulated and measured normalized radiation patterns of the rectangular DRA with the underlaid solar cell.
Figure 12:
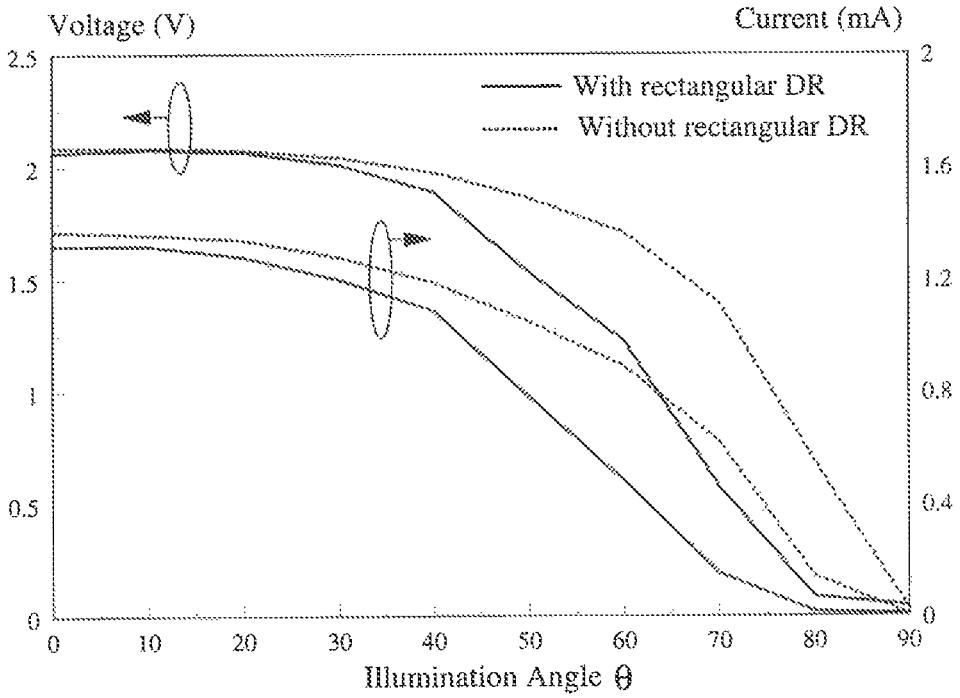
FIG. 12 shows output voltages and currents of the solar cell with and without the rectangular DRA where $R_c$=15 mm.

The results of the transparent rectangular DRA 12 (FIG. 1) are now discussed. FIG. 10 shows the simulated and measured reflection coefficients, whereas their corresponding input impedances are shown in the inset. With reference to the figure, the measured and simulated resonance frequencies of the rectangular DRA 12 are given by 1.91 GHz and 1.86 GHz, respectively, with an error of 2.7%. For the impedance bandwidth, the measured and simulated values are 17.6% and 15.8%, respectively. The resonance due to the solar cell is observed again in the measured result. Its resonance frequency slightly shifts from 2.25 GHz to 2.23 GHz due to the changes of the dielectric and excitation-strip loadings. The antenna gain of the transparent rectangular DRA 12 was also measured. It was found to be ~4.2 dBi around the resonance. The simulated and measured radiation patterns are shown in FIG. 11. As can be observed from the figure, the crosspolarized fields are weaker than the co-polarized ones by more than 25 dB in the boresight direction, showing that the rectangular DRA 12 has a very good polarization purity. FIG. 12 shows the measured output voltage and current using the same solar cell with $R_c$=15 mm. With reference to the figure, the rectangular DR 16 does not increase the outputs of the solar cell, suggesting that the rectangular DR 16 can be used for applications that do not require the focusing function. From the result, the focusing ability of the hemispherical DR 116 can be verified. Although the rectangular DR 16 does not provide the focusing function, its angular range for light reception is wider than its hemispherical counterpart, and the drop in its transparency above the solar cell is much smaller than the hemispherical version.

The dual or multi-function transparent hemispherical DRA 112 made of Borosilicate Crown Glass simultaneously functions as a radiating element and an optical focusing lens. The DR 116 can also serve as a protective cover for its underlaid solar cell 114. Since the DR 116 is transparent, the light can pass through it and illuminate on the underlaid solar cell. Because of the focusing effect of the DR 116, the voltage and current outputs of the solar cell can be increased. The system is very compact for the solar cell does not need any extra footprint. The second configuration that uses a transparent rectangular DR 16 is more suitable for applications that do not want the focusing effect.

Whilst the foregoing description of preferred embodiments of the invention comprise DRAs 12, 112, it will be understood that the principles described herein apply equally to any circuit for an electronic device or system employing a DR for whatever purpose such as filter or oscillator circuits. Important aspects of the invention include mounting a generally non-planar transparent DR on a circuit to perform a normal known function of said DR. The DR is mounted on another component so as to at least partially occupy a footprint of another component of the circuit. The another component is preferably a light processing component, namely a component such as a solar cell that processes received light to generate an electrical output or a light generating device such as a lamp or an LED that converts electrical energy to light energy. As such, by mounting the DR in the manner proposed, the DR can act as a protective cover for the light processing component whilst allowing light to pass therethough and even enhance the performance of the light processing component. In fact, where the DR is shaped as a lens or the like, it can act to enhance the performance of the light processing element by concentrating light energy onto a selected area. Furthermore, the DR does not require its own footprint thereby saving space on the circuit which is very useful in the design and manufacture of compact device such as wireless communication devices, although the invention is not limited to only such devices.

Figure 13:
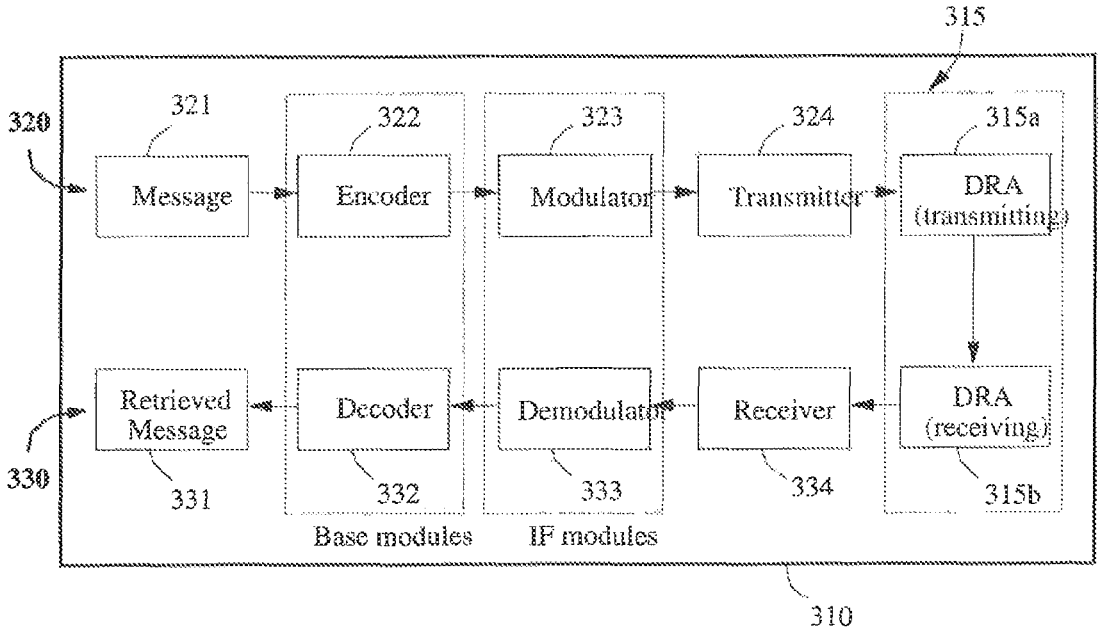
FIG. 13 is a schematic diagram of an electronic system having a DRA according to the invention.

FIG. 13 illustrates an electronic system 300 having a DRA in accordance with the invention. It will be understood that the DRAs of FIG. 1 or 2 could be employed in a suitable electronic device or system such as a mobile wireless handset, a personal digital assistant (PDA) or even a wireless base station. In fact, where the electronic device comprises a DRA incorporated with a solar cell, the device might comprise any electronic device requiring both a self-contained power source and an ability to wirelessly communicate with other devices or systems. For example, a parking meter having a solar power cell and DRA combination according to the invention would have a self-contained power source for operating the meter and a means of communicating wirelessly to say a control centre when the meter needs emptied or maintained or the like. The electronic system 300 of FIG. 13 comprises a housing 310 containing control and operational circuitry and at least one combined solar cell and DRA module 315 according to the invention whereby light impinging on the housing 310 is conveyed to a solar cell (not shown) of the at least one module 315 by its DRA. Alternatively, the electronic system 300 may comprise another form of optical component to that of a solar cell (or in addition to the solar cell) whereby light emitted by said optical component is conveyed to an exterior of the electronic system's housing 310 by the DRA acting as a light guide or pathway.

Figure 14A:
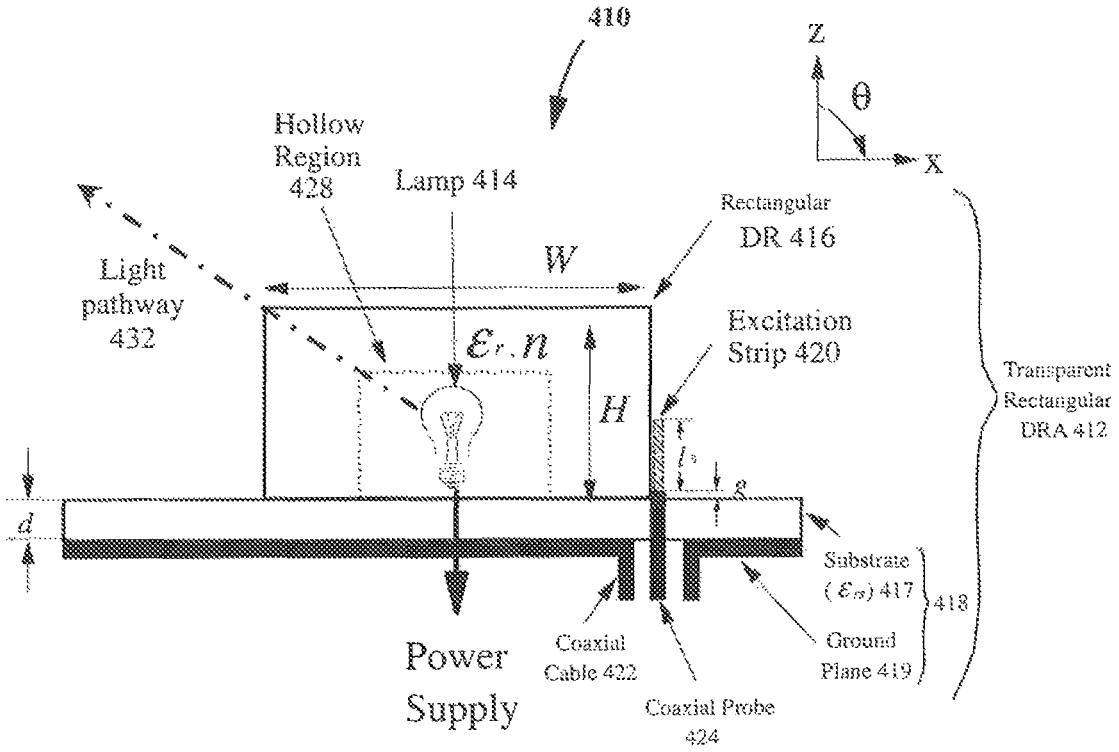
FIGS. 14*a* and 14*b* are front side and top views respectively illustrating a light transmissible DRA having a lamp in its hollow region according to the invention.
Figure 14B:
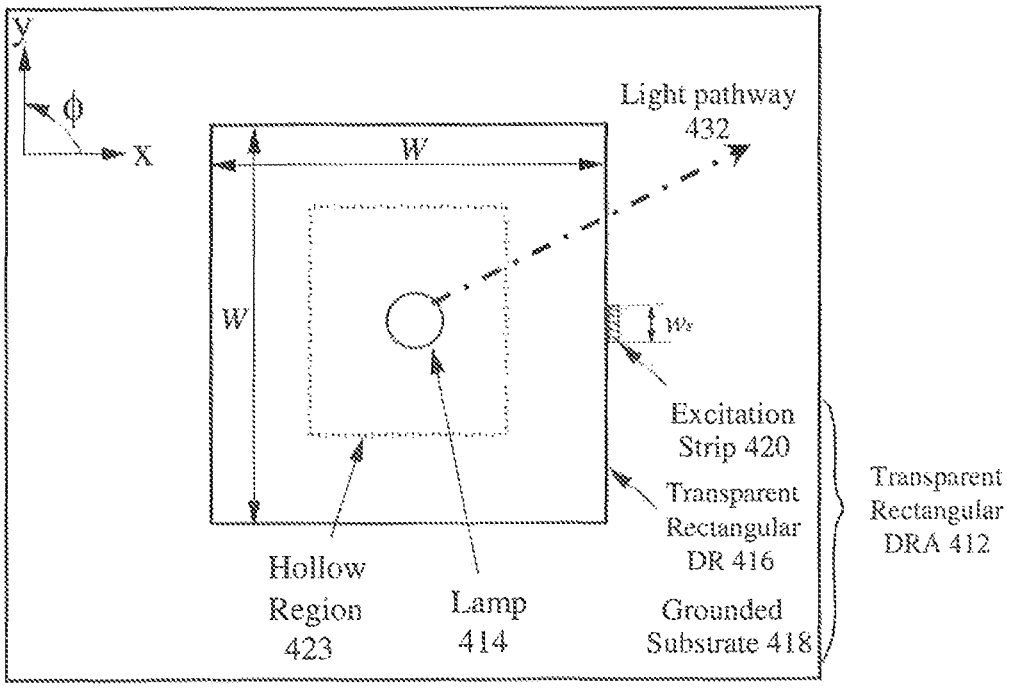

In the embodiment of an electronic system 300 as particularly illustrated by FIG. 13, there is provided a wireless communication device having a wireless signal transmit chain 320 and a wireless signal receive chain 330. The wireless signal transmit chain 320 comprises a message formatting or generating module 321 optionally followed by an encoding module 322. The encoding module 322 is followed by a modulator 323 and a signal transmitting module 324. The wireless signal transmit chain 320 is completed by a combined DRA and optical component module 315*a*. One skilled in the art will understand the functionality and purpose of each of the modules comprising the wireless signal transmit chain 320. In the case of the combined DRA and optical component module 315*a*, the DRA acts as a signal radiator, i.e. antenna, for the transmit chain 320. The optical component may comprise a solar cell for generating power for the electronic system 300 or a lamp or LED for generating a light output signal for the system 300. In the former case, the DRA comprises a DR according to the invention as depicted by FIG. 1 or 2 and, in the latter case, the DRA comprises a DR according to the invention as depicted by FIG. 14 as hereinafter described.

The wireless signal receive chain 330 comprises a message reformatting or retrieving module 331 optionally followed by a decoding module 332. The decoding module 332 is followed by a demodulator 333 and a signal receiving module 334. The wireless signal receive chain 330 is completed by a combined DRA and optical component module 315*b*. Again, one skilled in the art will understand the functionality and purpose of each of the modules comprising the wireless signal receive chain 330. In the case of the combined DRA and optical component module 315*b*, the DRA acts as a signal radiator, i.e. antenna, for the receive chain 330. The optical component may comprise a solar cell for generating power for the electronic system 300 or a lamp or LED for generating a light output signal for the system 300. Again, in the former case, the DRA comprises a DRA according to the invention as depicted by FIGS. 1 and 2 and, in the latter case, the DRA comprises a DRA according to the invention as depicted by FIG. 14 as hereinafter described. It will be appreciated that one of the combined modules 315*a,b* may comprise an optical component such as a solar cell for generating power for the electronic system 300 and the other may comprise a light generating means such as a lamp of an LED for said system 300.

One skilled in the art will recognize that the at least one combined DRA and optical component module 315*a,b* of the invention can be utilized in any device or system that employs a wireless signal radiating element (antenna) and an optical component for transmitting or receiving light at optical frequencies.

Furthermore, one skilled in the art will recognize that, where the electronic system comprises a filter or oscillator circuit or some other type of electronic circuit, the system may use at least one combined DR and optical component module where the DR does not comprise a DRA but comprises a DR for a filter, oscillator or other such circuit as will be familiar to one skilled in the art.

Whilst the main embodiments described above concern dielectric resonators, the invention is also applicable to electronic systems including hollow cavity resonators, dipole resonators and other types of resonators but not including microstrip patch or slot resonators. The key feature of the invention is the use of a light transmissible DRA in a circuit where the DR shares at least part of the footprint of another component but allows light to pass through the DR towards and/or away from said another component, particularly where said another component is a light processing or generating component. The invention generally envisages using non-planar transparent DR in circuits in the aforementioned manner.

More specifically, the invention provides an electronic device including a DRA, wherein the DRA functions as an antenna of said electronic device and wherein said DRA is positioned in said device so that the DR is located so as to intercept light travelling along a light pathway of said device. The electronic device includes in some embodiments a device for generating power from light impinging on said device, wherein said power generating device is located such that light impinging upon said device travels through at least a part of the DR of the DRA.

In the foregoing preferred embodiments, the DR may be a DR of a dielectric resonator antenna (DRA), said DRA comprising one of a plurality of DRAs arranged in a DRA array or a DRA reflect-array. An antenna array is a matrix of antennas used to increase the gain of an antenna system.

It can also be seen that the invention provides a method of producing a DRA comprising providing a DRA having: a DR; a ground plane; and a strip feedline for the DR; and forming the DR from a material that is transmissable to light at optical frequencies.

Finally, it should be noted that the transparency feature of the DR can find other optical applications. For example, as illustrated in FIGS. 14*a* and *b*, a light source 414 (e.g., an LED or lamp) can be placed inside a hollow region 423 of transparent DR 416 on a circuit 410 to give a lamp that also works as an antenna. This embodiment of a light generating optical component (lamp or LED) located within a DRA or even component other than an antenna shares similarities with the circuits 10, 110 of FIGS. 1 and 2 and thus like numerals preceded by a "4" are used to denote like parts.

The ability to control propagation of electromagnetic radiation is important in many different technology areas, such as optical fiber systems and electronic devices. Devices for controlling propagation of electromagnetic radiation can form important components in many electronic and optical devices. For example, modulators are used in optical fiber systems for modulating an intensity of a carrier signal in order to generate an encoded signal. Modulators can also form important components in photonic integrated circuits ("PICs") that include electronic devices and optoelectronic devices. PICs are the photonic equivalent of electronic integrated circuits and may be implemented on a semiconductor substrate that forms the base of the electronic and optoelectronic devices. As one example, a modulator can be used to modulate an optical signal that is communicated between different electronic devices or different functional circuitry on the same substrate. DR form important component parts of optical fiber systems, PICs and other electronic devices and systems. The reference to a DR according to the invention hereinbefore described with reference to the drawings is to be taken as a reference to such DR being incorporated into circuits for optical fiber systems, PICs and other electronic devices and systems.

In the claims appended hereto, references to electronic circuit or electronic system are to be taken as comprising references also to photonic integrated circuits or systems and opto-electronic circuits or systems.

In general, the invention provides a circuit for a device having a non-planar transparent DRA. The transparent DR is mounted on another component so as to at least partially occupy a footprint of another component of the circuit. The transparent DR forms part of a light pathway on said circuit for transmitting light to or from said another component. Also provided is a transparent dielectric resonator antenna (DRA) for optical applications. Since the DR is transparent, it can let light pass through itself and, thus, the light can be utilized by an optical part of a system or device. The transparent DR can be placed on top of a solar cell. Since the DR does not block the light, the light can reach the solar cell and power can be generated for the system or device. The system or device so obtained is very compact because no extra footprint is needed within the system or device for the DRA. It finds application in compact wireless applications that need a self-sustaining power device.

While the invention has been illustrated and described in detail in the drawings and foregoing description, the same is to be considered as illustrative and not restrictive in character, it being understood that only exemplary embodiments have been shown and described and do not limit the scope of the invention in any manner. It can be appreciated that any of the features described herein may be used with any embodiment. The illustrative embodiments are not exclusive of each other or of other embodiments not recited herein. Accordingly, the invention also provides embodiments that comprise combinations of one or more of the illustrative embodiments described above. Modifications and variations of the invention as herein set forth can be made without departing from the spirit and scope thereof, and, therefore, only such limitations should be imposed as are indicated by the appended claims.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art, in Australia or any other country.

The invention claimed is:

1. An electronic device having a non-planar transparent dielectric resonator antenna with a non-planar transparent dielectric resonator element and a light generating element, wherein the non-planar transparent dielectric resonator element is mounted above on the light generating element so as to at least partially enclose the light generating element; and wherein said non-planar transparent dielectric resonator element forms part of a light pathway for transmitting light from said light generating element to an exterior of the electronic device.

2. The electronic device of claim 1, wherein the non-planar transparent dielectric resonator element is hemispherical shaped so as to diverge light transmitted from the light generating element.

3. The electronic device of claim 1, wherein the non-planar transparent dielectric resonator element is transparent to light at and/or beyond optical frequencies.

4. The electronic device of claim 1, wherein the non-planar transparent dielectric resonator element comprises is made of borosilicate glass material.

5. The electronic device of claim 1, wherein the non-planar transparent dielectric resonator element comprises a hollow region arranged to accommodate the light generating element.

* * * * *